US005662412A

United States Patent [19]

Glendmyer

[11] Patent Number: 5,662,412

[45] Date of Patent: Sep. 2, 1997

[54] REMOVABLE COVER FOR A LAMP SHADE

[76] Inventor: Charlotte Glendmyer, 24 Canterbury Rd., Ringwood, N.J. 07456

[21] Appl. No.: 606,448

[22] Filed: Feb. 23, 1996

Related U.S. Application Data

[63] Continuation-in-part of Ser. No. 398,172, Mar. 2, 1995, abandoned, which is a continuation-in-part of Ser. No. 14,468, Oct. 22, 1993, abandoned.

[51] Int. Cl.[6] ..... F21V 11/00

[52] U.S. Cl. ..... 362/351; 362/352; 362/357; 362/806

[58] Field of Search ..... 362/351, 352, 362/355, 356, 357, 358, 457, 458, 806

[56] References Cited

U.S. PATENT DOCUMENTS

| | | | |
|---|---|---|---|
| 4,212,052 | 7/1980 | Chambard | 362/352 |
| 4,731,715 | 3/1988 | Anderson | 362/352 |
| 5,211,474 | 5/1993 | Leitner et al. | 362/351 |
| 5,532,912 | 7/1996 | Bendit | 362/352 |

*Primary Examiner*—Alfred Basichas
*Attorney, Agent, or Firm*—Alfred C. Hill

[57] ABSTRACT

A removable cover for an existing lamp shade having a base structure covered by an outer decorative material comprising a piece of new decorative fabric having a new decor conforming to the shape and size of the existing lamp shade to cover the outer decorative material, the new decorative fabric having a first portion adjacent to a top of the outer decorative material and a second portion adjacent to a bottom of the outer decorative material; a pair of VELCRO strips each having a hook portion and a loop portion; a selected one of the hook portion and the loop portion of one of the pair of strips being fastened to a first predetermined location on the outer decorative material adjacent the top thereof; a second one of the hook portion and the loop portion of the other of the pair of strips being fastened to a second predetermined location on the outer decorative material adjacent the bottom thereof; the other of the hook portion and the loop portion of one of the pair of strips being fastened to the first portion of the new decorative fabric in a mating relation with the selected one of the hook portion and the loop portion of the one of the pair of strips; and the other of the hook portion and the loop portion of the other of the pair of strips being fastened to the second portion of the new decorative fabric in a mating relation with the selected one of the hook portion and the loop portion of the other of the pair of strips; the pair of strips thereby enabling removably securing the new decorative fabric to the outer decorative material to removably cover the existing lamp shade without removing the outer decorative material.

20 Claims, 1 Drawing Sheet

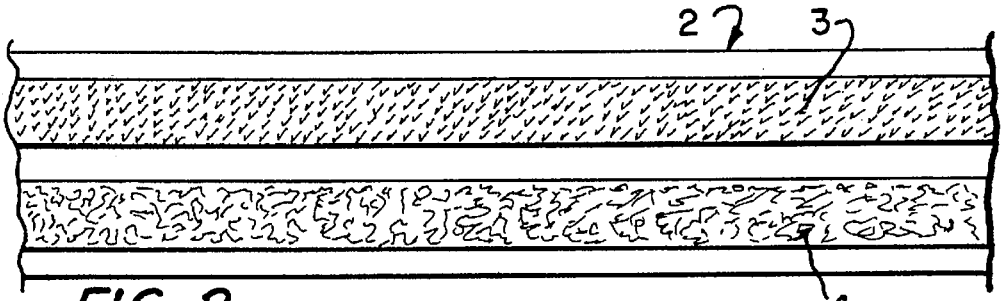
FIG. 2
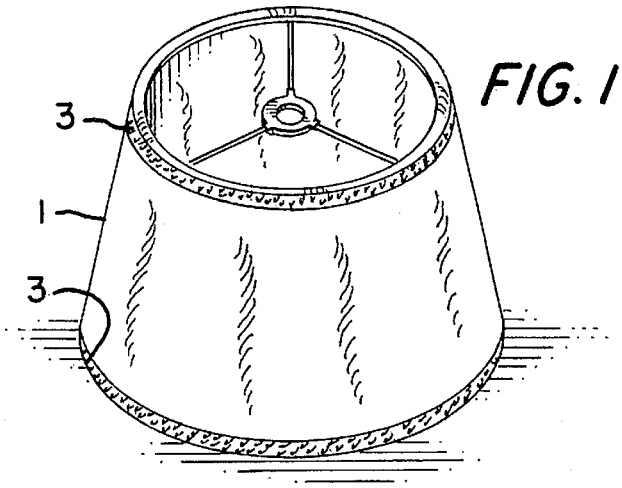
FIG. 1
FIG. 3
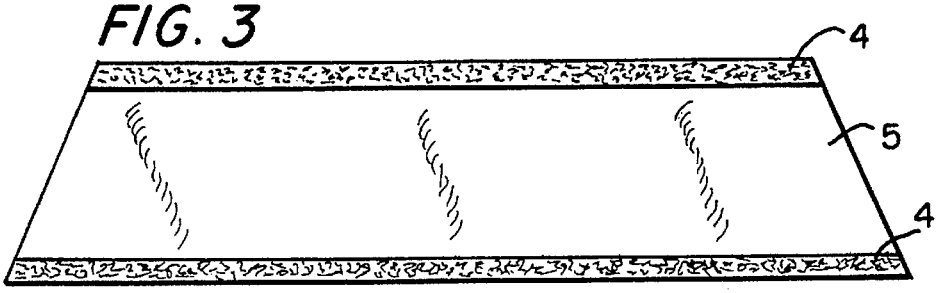
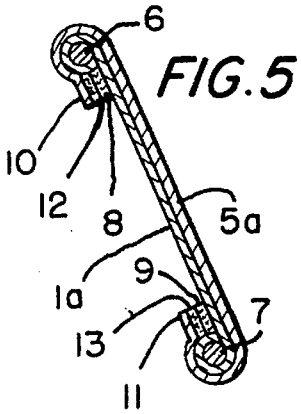
FIG. 5
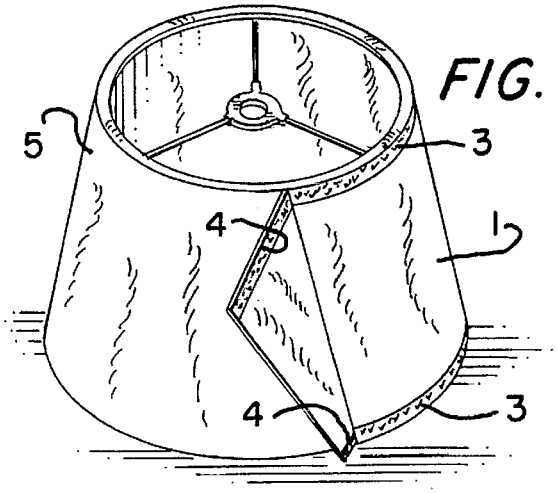
FIG. 4

REMOVABLE COVER FOR A LAMP SHADE

CROSS REFERENCE TO RELATED APPLICATION

The present application is a continuation-in-part application of earlier filed application Ser. No. 08/398,172, filed Mar. 2, 1995, now abandoned, which is a continuation-in-part of earlier filed application Ser. No. 29/014,468, filed Oct. 22, 1993, now abandoned.

BACKGROUND OF THE INVENTION

The present invention relates generally to home furnishing accessories and more particularly to a removable covering for an existing lamp shade diffuser, commonly referred to only as a lamp shade, having an originally manufactured, decorative cover on an outer surface of the existing lamp shade.

Lamp shades are typically manufactured for sale purposes of relatively stiff, but lightweight material stretched about a metal frame employing manufacturing techniques similar to that disclosed in U.S. Pat. Nos. 5,211,474 and 4,212,052. After an extended period of use in a home, an apartment and the like, the shade may become outdated or discolored so that replacement is desirable. An exact lamp shade replacement, in some cases, may not be possible. On other occasions, it may be desirable to coordinate the appearance of the lamp shade with other room furnishings, such as curtains, bedding, linen, pillows and the like. The range of conventional lamp shade patterns and colors which are available for purchase for such fashion coordination is limited, and is generally expensive.

Decorator lamp shades which are selected to match a decor are expensive to purchase. Accordingly, many homeowners must suffer an inappropriately selected material rather than incur the expense of a decorator lamp shade.

In times of rising costs, homeowners are increasingly turning to do-it-yourself projects for both cost savings and personal satisfaction.

Manufactured lamp shades come in all different shapes and sizes and the cover for an existing lamp shade must be able to accommodate these different shapes and sizes with the shapes running from almost cylindrical to exaggerated conical shape.

U.S. Pat. No. 5,211,474 discloses a do-it-yourself lamp shade kit which enables the homeowner to manufacture a basic lamp shade having a wire frame surrounded by a frusto-conical shaped base material which accepts and adheres to fabric adhesives. After a fabric selected by the homeowner is cut out according to the pattern supplied with the kit, the fabric is permanently secured to the base material by a fabric adhesive. To change the decor of the thusly manufactured lamp shade, another kit must be purchased and a new fabric of desired decor must be applied to the base material of the new kit by a fabric adhesive. U.S. Pat. No. 4,731,715 discloses a cover for a lamp shade which provides a draw string to fasten the cover to an existing lamp shade. U.S. Pat. No. 2,593,272 discloses a lamp shade having the lamp shade material secured to the frame by means of stiff, but flexible strips which are detachable so that the lamp shade material can be changed. U.S. Pat. No. 666,683 discloses a lamp shade incorporating ribs therein, but is not concerned with a lamp shade that can be changed, or a cover for a lamp shade to change the decor thereof. U.S. Pat. No. 4,212,052 discloses a kit for the home manufacture of a lamp shade having a pair of lamp shade rings, a fabric for the lamp shade and pile-type fastener tapes fastened to the fabric. The homeowner then loops the fabric tape about each of the lampshade rings to form the desired lamp shade. With this arrangement the decor is changed by undoing the fabric tape to free the lamp shade rings and provide a fabric with a new desired decor with fabric tapes secured thereto so that the lamp shade can be rebuilt as above.

It should be clearly understood that the phrase "existing lamp shade", as used in the specification and claims, refers to a lamp shade manufactured for purchase in a store, or a lamp shade made by a homeowner from kits similar to those disclosed in U.S. Pat. Nos. 4,212,052 and 5,211,474 with an outer decorative cover.

SUMMARY OF THE INVENTION

An object of the present invention is to provide an improved lamp shade cover for an existing lamp shade.

Another object of the present invention is to provide a lamp shade cover for an existing lamp shade which can be readily removed to clean by washing or dry-cleaning and able to be easily replaced back on the existing lamp shade.

Still another object of the present invention is to provide a lamp shade cover for an existing lamp shade having an outer decorative cover that can be covered to enable redecoration of the existing lamp shade without changing the structure of the existing lamp shade itself.

A further object of the present invention is to provide a lamp shade cover that is compatible with all shapes and sizes of existing lamp shades.

A feature of the present invention is the provision of a removable cover for an existing lamp shade having at least a base structure covered by an outer decorative material comprising a piece of new decorative fabric having a different decor than the outer decorative material conforming to the shape and size of the existing lamp shade to cover the outer decorative material thereof, the new decorative fabric having a first portion adjacent to the top of the outer decorative material and a second portion adjacent to a bottom of the outer decorative material; a pair of VELCRO strips each having a hook portion and a loop portion; a selected one of the hook portion and the loop portion of one of the pair of strips being fastened to a first predetermined location on the outer decorative material adjacent the top thereof; a selected one of the hook portion and the loop portion of the other of the pair of strips being fastened to a second predetermined location on the outer decorative material adjacent the bottom thereof; the other of the hook portion and the loop portion of the one of the pair of strips being fastened to the first portion of the new decorative fabric in a mating relation with the selected one of the hook portion and the loop portion of the one of the pair of strips; and the other of the hook portion and the loop portion of the other of the pair of strips being fastened to the second portion of the new decorative fabric in a mating relation with the selected one of the hook portion and the loop portion of the other of the pair of strips; the pair of strips thereby enabling removably securing the new decorative fabric to the outer decorative material of the existing lamp shade to removably cover the existing lamp shade without removal of the its outer decorative material.

Another feature of the present invention is the provision of a method of covering an existing lamp shade having at least a base structure covered by an outer decorative material with a removable cover having a new decor to cover the outer decorative material comprising the steps of fastening a selected one of a hook portion and a loop portion of a first VELCRO strip to a first predetermined location adjacent a top of the outer decorative material; fastening the other of the hook portion and the loop portion of the first strip to a first portion of a piece of new decorative fabric having a different decor than the outer decorative material to be used as the removable cover to enable mating the hook portion and the loop portion of the first strip to thereby removably secure the first portion of the new decorative fabric to the top of the outer decorative material; fastening a selected one of a hook portion and a loop portion of a second VELCRO strip to a second predetermined location adjacent a bottom of the outer decorative material; and fastening the other of the hook portion and the loop portion of the second strip to a second portion of the new decorative fabric to enable mating the hook portion and the second strip to thereby removably secure the second portion of the fabric to the bottom of the outer decorative material to provide with the first strip and the new decorative fabric the removable cover for the existing lamp shade without removal of the outer decorative material.

A further feature of the present invention is the provision of a do-it-yourself kit to enable covering an existing lamp shade having at least a base structure covered by an outer decorative material with a removable cover to alter the decor thereof comprising a piece of new decorative fabric having a different decor than the outer decorative material shaped to conform to the shape and size of the existing lamp shade to cover the outer decorative material thereof; and a pair of VELCRO strips each having a hook portion and a loop portion, a selected one of a hook portion and a loop portion of one of the pair of strips to be fastened to the decorative outer material in a first predetermined location adjacent a top of the outer decorative material, a selected one of the hook portion and the loop portion of the other of the pair of strips to be fastened to the outer decorative material at a second predetermined location adjacent a bottom of the outer decorative material, the other of the hook portion and the loop portion of the one of the pair of strips to be fastened to the new decorative fabric at a first position thereon to enable mating of the selected one and the other of the hook portion and a loop portion of the one of the pair of strips and the other of the hook portion and loop portion of the other of the pair of strips to be fastened to the new decorative fabric at a second position thereon to enable mating the selected one and the other of the hook portion and the loop portion of the other of the pair of strips to provide the removable cover for the outer decorative material existing lamp shade without removing the outer decorative material.

BRIEF DESCRIPTION OF THE DRAWING

The above-mentioned and other features and objects of the present invention will become more apparent by reference to the following description taken in conjunction with the accompanying drawing, in which:

FIG. 1 is a perspective view of a representative existing lamp shade incorporating a portion of the removable lamp shade system in accordance with the principles of the present invention;

FIG. 2 is a plan view of a VELCRO strip employed in accordance with the principles of the present invention;

FIG. 3 is a plan view of a piece of fabric incorporating a portion of the system to enable providing a removable cover for an existing lamp shade in accordance with the principles of the present invention;

FIG. 4 is a perspective view illustrating the manner in which the fabric of FIG. 3 is removably attached to the existing lamp shade of FIG. 1; and FIG. 5 is a cross-sectional view of an alternative arrangement for removably attaching the fabric of FIG. 3 to an existing lamp shade similar to the existing lamp shade of FIG. 1 in accordance with the principles of the present invention.

DESCRIPTION OF THE PREFERRED EMBODIMENTS

Referring to FIG. 1, there is illustrated therein an existing lamp shade formed of a frame or base structure and an outer decorative material 1 covering the base structure. The lamp shade is used to diffuse the light of the bulb. As previously mentioned, it may be desired to change the decor of an existing lamp shade to match the decor of the room in which the existing lamp shade is used. It is also pointed out that to get designer lamp shades it is very expensive and at times the material employed in the designer lamp shade are not that desired by the homeowner. Accordingly, in accordance with the principles of the present invention there is provided herein an arrangement to enable the homeowner to provide their own decorative fabric or material to match the decor of the room in which the existing lamp shade is used so that the homeowner can simply cover the existing lamp shade outer decorative material with a new decorative fabric having a desired new decor and also to enable removal of this new decorative fabric or cover if it becomes dirty and needs to be washed or dry-cleaned. Alternatively, the cover or new decorative fabric of the present invention can be removed from the outer decorative material of the existing lamp shade without destruction thereof to replace that cover or new decorative fabric with another cover or new decorative fabric having a different decor to match the decor of a redecoration that has taken place in the room in which the existing lamp shade is used.

In accordance with the principles of the present invention, a pair of strips of VELCRO 2, as illustrated in FIG. 2, including a hook portion 3 and a loop portion 4 are employed in the removable lamp shade cover.

As shown in FIG. 1, a selected one of the hook portion 3 and loop portion 4 of one of the pair of VELCRO strips 2, such as the hook portion 3, is placed at the top of and on the outer surface of the outer decorative material 1. A selected one of the hook portion 3 and loop portion 4 of the other of the pair of VELCRO tape 2 is fastened adjacent the bottom of the outer decorative material 1, illustrated in FIG. 1 to be the hook portion 3.

The other of the hook portion 3 and the loop portion 4 of the one of the pair of VELCRO strips 2, illustrated in FIG. 3 to be loop portion 4, is fastened to a first portion of a new decorative fabric 5 to cover the outer outer decorative material 1. This first portion of the new decorative fabric 5 conforms to the top of the outer decorative material 1. The other of the hook portion 3 and loop portion 4 of the other of the pair of strips 2, illustrated in FIG. 3 to be loop portion 4, is fastened to a second portion of the new decorative fabric 5 adjacent the bottom. The bottom or second portion of new decorative fabric 5 conforms to the bottom of outer decorative material 1. Loop portions 4 on the new decorative fabric 5 are positioned thereon to mate with the hook portion 3 at the top and bottom of the outer decorative material 1, as illustrated in FIG. 4.

It should be clearly understood that the hook portions 3 and the loop portions 4 of the two VELCRO strips 2 can be interchanged so that the loop portions 4 are disposed at the top and bottom of the outer decorative material 1 and the hook portions 3 are disposed at the top and bottom of the new decorative fabric 5. It should also be understood that the hook and loop portions of the pair of VELCRO strips 2 can be fastened to the outer decorative material 1 and the new decorative fabric 5 by gluing the same thereto with an appropriate strong adhesive, or by sewing the hook and loop portions of the pair of VELCRO strips 2 to the outer decorative material 1 and the new decorative fabric 5.

As pointed out hereinabove, the new decorative fabric 5 used to provide a removable cover for the existing lamp shade can be made from any kind or type of material the homeowner desires provided the material complies with the Federal Regulations of the fire safety codes. Also, the new decorative fabric 5 can be made in any shape or size to fit various lamp shades of different sizes and shapes.

Preferably the removable lamp shade cover will be provided in a kit form that would include the piece of new decorative fabric 5 of appropriate shape and size to fit the existing lamp shade to be covered and a pair of VELCRO strips 2 with appropriate instructions as to how the hook and loop portions 3 and 4 of the pair of VELCRO strips 2 would be fastened on the outer decorative material 1 and on the new decorative fabric 5.

In FIG. 1 it is illustrated that the hook or loop portion is applied to the outer decorative material 1 on the outer surface thereof with the other of the hook portion 3 and loop portion 4 of the VELCRO strips 2 being applied to the inner surface of the new decorative fabric 5.

Referring to FIG. 5, there is illustrated therein a cross section of an alternative manner in which the new decorative fabric 5 can be removably fastened to the outer decorative material 1*a* of an existing lamp shade. As shown, the outer decorative material 1*a* is wrapped around the frame members 6 and 7 at the top and bottom thereof. A selected one of the hook portion and loop portion of each of the pair of VELCRO strips as shown at 8 and 9 is fastened to the inner surface of outer decorative material 1*a* adjacent the top and bottom thereof, respectively. The other of the hook portion and loop portion of the pair of VELCRO strips is fastened to the inner surface of an extension 10 and 11 of new decorative fabric 5*a* as shown in at 12 and 13. Extensions 10 and 11 are wrapped around the outer decorative material 1*a* in a manner to cause the mating of the respective hook and loop portions of the pair of VELCRO strips to thereby secure new decorative fabric 5*a* to the outer decorative material 1*a* of an existing lamp shade.

While I have described above the principles of my invention in connection with specific apparatus, it is to be clearly understood that this description is made only by way of example and not as a limitation to the scope of my invention as set forth in the objects thereof and in the accompanying claims.

I claim:

1. A method of covering an existing lamp shade having at least a base structure covered by an outer decorative material with a removable cover having a new decor comprising the steps of fastening a selected one of a hook portion and a loop portion of a first VELCRO strip to a first predetermined location adjacent a top of said outer decorative material;

fastening the other of said hook portion and said loop portion of said first strip to a first portion of a piece of new decorative fabric having said new decor to be used as said removable cover to enable mating said hook portion and said loop portion of said first strip to thereby removably secure said first portion of said new decorative fabric to said top of said outer decorative material fastening a selected one of a hook portion and a loop portion of a second VELCRO strip to a second predetermined location adjacent a bottom of said outer decorative material; and fastening the other of said hook portion and said loop portion of said second strip to a second portion of said new decorative fabric to enable mating said hook portion and said loop portion of said second strip to thereby removably secure said second portion of said new decorative fabric to said bottom of said outer decorative material to provide with said first strip and said new decorative fabric said removable cover for said outer decorative material of said existing lamp shade without removal of said outer decorative material.

2. A method according to claim 1, wherein said first predetermined location is an outer surface of said outer decorative material.

3. A method according to claim 2, wherein said second predetermined location is an outer surface of said outer decorative material.

4. A method according to claim 3, wherein the steps of fastening said other of said hook portion and said loop portion of both of said first and second strips includes the step of fastening said other of said hook portion and said loop portion to an inner surface of said new decorative fabric.

5. A method according to claim 1, wherein said first predetermined location is an inner surface of said outer decorative material.

6. A method according to claim 5, wherein said second predetermined location is an inner surface of said outer decorative material.

7. A method according to claim 6, wherein the steps of fastening said other of said hook portion and said loop portion of both said first and second strips includes the steps of extending said new decorative fabric over an edge of both said top and/said bottom of said outer decorative material;

folding said extended decorative fabric to be adjacent said inner surface of said outer decorative material; and fastening said other of said hook portion and said loop portion of both of said first and second strips to an inner surface of an associated one of said extended new decorative fabric to mate with an associated one of said selected one of said hook portion and said loop portion of both said first and second strips.

8. A removable cover for an existing lamp shade having at least a base structure covered by an outer decorative material comprising:

a piece of new decorative fabric having a decor different than said outer decorative material conforming to the shape and size of said existing lamp shade to cover said outer decorative material, said new decorative fabric having a first portion adjacent to a top of said outer decorative material and a second portion adjacent to a bottom of said outer decorative material;

a pair of VELCRO strips each having a hook portion and a loop portion;

a selected one of said hook portion and said loop portion of one of said pair of strips being fastened to a first predetermined location on said outer decorative material adjacent said top thereof;

a selected one of said hook portion and said loop portion of the other of said pair of strips being fastened to a second predetermined location on said outer decorative material adjacent said bottom thereof;

the other of said hook portion and said loop portion of said one of said pair of strips being fastened to said first portion of said new decorative fabric in a mating relation with said selected one of said hook portion and said loop portion of said one of said pair of strips; and the other of said hook portion and said loop portion of said other of said pair of strips being fastened to said second portion of said new decorative fabric in a mating relation with said selected one of said hook portion and said loop portion of said other of said pair of strips;

said pair of strips thereby enabling removably securing said new decorative fabric to said outer decorative material to cover the same without removal thereof.

9. A cover according to claim 8, wherein said first predetermined location is an outer surface of said outer decorative material.

10. A cover according to claim 9, wherein said second predetermined location is an outer surface of said outer decorative material.

11. A cover according to claim 10, wherein said other of said hook portion and said loop portion of both of said pair of strips is fastened to an inner surface of said new decorative fabric.

12. A cover according to claim 8, wherein said first predetermined location is an inner surface of said outer decorative material.

13. A cover according to claim 12, wherein said second predetermined location is an inner surface of said outer decorative material.

14. A cover according to claim 13, wherein said other of said hook portion and said loop portion of both of said pair of strips is fastened to an inner surface of a portion of said new decorative fabric extending over an adjacent edge of said outer decorative material so that said other of said hook portion and said loop portion of both of said pair of strips will mate with its associated one of said selected one of said hook portion and said loop portion of both of said pair of strips.

15. A do-it-yourself kit to enable covering an existing lamp shade having at least a base structure covered by an outer decorative material with a removable cover to alter the decor of said existing lamp shade without removal of said outer decorative material comprising:

a piece of new decorative fabric having a decor different than said outer decorative material shaped to conform to the shape and size of said existing lamp shade to cover said outer outer decorative material; and a pair of VELCRO strips each having a hook portion and a loop portion, a selected one of said hook portion and said loop portion of one of said pair of strips to be fastened to said outer decorative material at a first predetermined location adjacent a top of said outer decorative material, a selected one of said hook portion and said loop portion of the other of said pair of strips to be fastened to said outer decorative material at a second predetermined location adjacent a bottom of said outer decorative material, the other of said hook portion and said loop portion of said one of said pair of strips to be fastened to said new decorative fabric at a first position thereon to enable mating of said selected one and said other of said hook portion and said loop portion of said one of said pair of strips and the other of said hook portion and said loop portion of said other of said pair of strips to be fastened to said new decorative fabric at a second position thereon to enable mating said selected one and said other of said hook portion and said loop portion of said other of said pair of strips to provide removable cover for said outer decorative material of said existing lamp shade without removing said outer decorative material.

16. A kit according to claim 15, wherein said first predetermined location is an outer surface of said outer decorative material.

17. A kit according to claim 16, wherein said second predetermined location is an outer surface of said outer decorative material.

18. A kit according to claim 17, wherein said other of said hook portion and said loop portion of both of said pair of strips is fastened to an inner surface of said new decorative fabric.

19. A kit according to claim 15, wherein said first predetermined location and said second predetermined location are both on an inner surface of said outer decorative material.

20. A kit according to claim 19, wherein said other of said hook portion and said loop portion of both of said pair of strips is fastened to an inner surface of a portion of said new decorative fabric extending over an adjacent edge of said outer decorative material so that said other of said hook portion and said loop portion of both of said pair of strips will mate with its associated one of said selected one of said hook portion and said loop portion of both of said pair of strips.

* * * * *